US012535284B1

(12) United States Patent
Bray

(10) Patent No.: US 12,535,284 B1
(45) Date of Patent: Jan. 27, 2026

(54) LINEAR TRIGGER BOLT ACTION FIREARM

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 19/085,313

(22) Filed: Mar. 20, 2025

(51) Int. Cl.
*F41A 19/10* (2006.01)
*F41A 17/56* (2006.01)
*F41A 19/12* (2006.01)

(52) U.S. Cl.
CPC ..... *F41A 19/10* (2013.01); *F41A 17/56* (2013.01); *F41A 19/12* (2013.01)

(58) Field of Classification Search
CPC ..... F41A 19/10; F41A 17/56; F41A 19/12
See application file for complete search history.

(56) References Cited

U.S. PATENT DOCUMENTS 6,382,200 B1 * 5/2002 Levkov ..... F41A 19/12 124/71
8,615,915 B2 * 12/2013 Hunter ..... F41A 19/10 42/72
10,578,385 B2 * 3/2020 Dextraze ..... F41A 19/10
10,767,950 B2 9/2020 Lake
10,801,795 B2 10/2020 Lipowski
10,809,030 B2 10/2020 Geissele et al.
11,385,012 B2 7/2022 Lipowski
11,598,599 B2 * 3/2023 Bray ..... F41A 19/45
11,624,570 B1 * 4/2023 Rainaud ..... F41A 17/46 42/17
11,754,360 B2 * 9/2023 Anderson ..... F41A 19/10 42/69.01
11,982,504 B2 5/2024 Dextraze et al.
12,038,246 B1 * 7/2024 Withey ..... F41A 19/12
12,111,126 B2 * 10/2024 McNamee ..... F41A 19/10
2023/0136519 A1 5/2023 Maughan et al.
2024/0044599 A1 2/2024 Lipowski
2024/0310133 A1 * 9/2024 Rainaud ..... F41A 11/00

* cited by examiner

*Primary Examiner* — Michelle Clement
(74) *Attorney, Agent, or Firm* — Kunzler Needham & Hilton

(57) ABSTRACT

Disclosed is a linear trigger mechanism for a firearm. In certain examples, the trigger mechanism includes a trigger housing having a linear trigger pathway and a removeable side plate. The trigger mechanism also includes a trigger that is at least partially disposed between the trigger housing and the removeable side plate, where the trigger is configured to move between a first position and a second position along a path that is defined by the trigger pathway, and where the trigger includes an angled sear engagement surface. The trigger mechanism also includes a sear that is at least partially disposed between the trigger housing and the removeable side plate and is configured to pivot with respect to the trigger housing, where the sear includes an angled trigger engagement surface that corresponds with the angled sear engagement surface.

18 Claims, 7 Drawing Sheets

LINEAR TRIGGER BOLT ACTION FIREARM

FIELD

This disclosure relates generally to firearms, and more particularly to linear trigger mechanisms for bolt-action firearms.

BACKGROUND

Firearms typically have a trigger mechanism that is used to discharge the firearm. A trigger assembly configured for use with a bolt-action rifle commonly includes a mechanism for restraining a spring-loaded firing pin, or striker that, when released, strikes a primer of an unfired cartridge loaded in a chamber of a rifle.

The trigger assembly restrains the firing pin until the user actuates the trigger assembly by pulling or otherwise exerting pressure on a rotating or linear trigger motion.

Also, trigger assemblies are exposed to dirt, carbon, and other contaminants during normal use, and thus need to be cleaned and lubricated on a periodic basis. Trigger assemblies that are overly complicated and require significant disassembly to clean and lubricate, are difficult to maintain, or because of their complexity are not user-serviceable will not receive proper maintenance that will compromise reliability and safety.

The firing pin in turn strikes an ammunition cartridge positioned in a chamber of the firearm. Pulling a trigger of the trigger mechanism initiates this sequence. A rough or uneven trigger pull can affect the accuracy of the firearm.

SUMMARY

Disclosed is a linear trigger mechanism for a firearm. In certain examples, the trigger mechanism includes a trigger housing having a linear trigger pathway and a removeable side plate. The trigger mechanism also includes a trigger that is at least partially disposed between the trigger housing and the removeable side plate, where the trigger is configured to move between a first position and a second position along a path that is defined by the trigger pathway, and where the trigger includes an angled sear engagement surface. The trigger mechanism also includes a sear that is at least partially disposed between the trigger housing and the removeable side plate and is configured to pivot with respect to the trigger housing, where the sear includes an angled trigger engagement surface that corresponds with the angled sear engagement surface.

In certain examples, the linear trigger pathway has a length in the range of between about 0.05 and 0.5 inches. The trigger housing includes a trigger guide shelf configured to engage a pocket formed in an upper portion of the trigger, where the trigger guide shelf prevents rotational movement of the trigger with respect to the trigger housing. In certain examples, the trigger guide shelf has a length that is greater than a length of the linear trigger pathway.

In certain examples, the trigger mechanism also includes a safety selector configured to move between a first position that prevents movement of the sear with respect to the trigger housing and a second position that allows movement of the sear with respect to the trigger housing. The safety selector, in certain examples, includes a sear engagement tab that is moveable into and out of engagement with a tab of the sear. The tab forms a pocket with a body portion of the sear, and the pocket is configured to receive the sear engagement tab when the safety selector is in the second position.

In certain examples, the sear engagement tab of the safety selector aligns with and contacts the tab of the sear when the safety selector is in the first position to prevent the sear from moving with respect to the trigger housing. The trigger mechanism also includes, in certain examples, a roller pin captured between the angled sear engagement surface and the angled trigger engagement surface, where the roller pin is configured to transfer a force applied to the trigger by a user to the sear. The trigger mechanism may also include a compression spring disposed between the trigger and the trigger housing configured to return the trigger to a first position.

Also disclosed is a firearm that includes the trigger housing.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
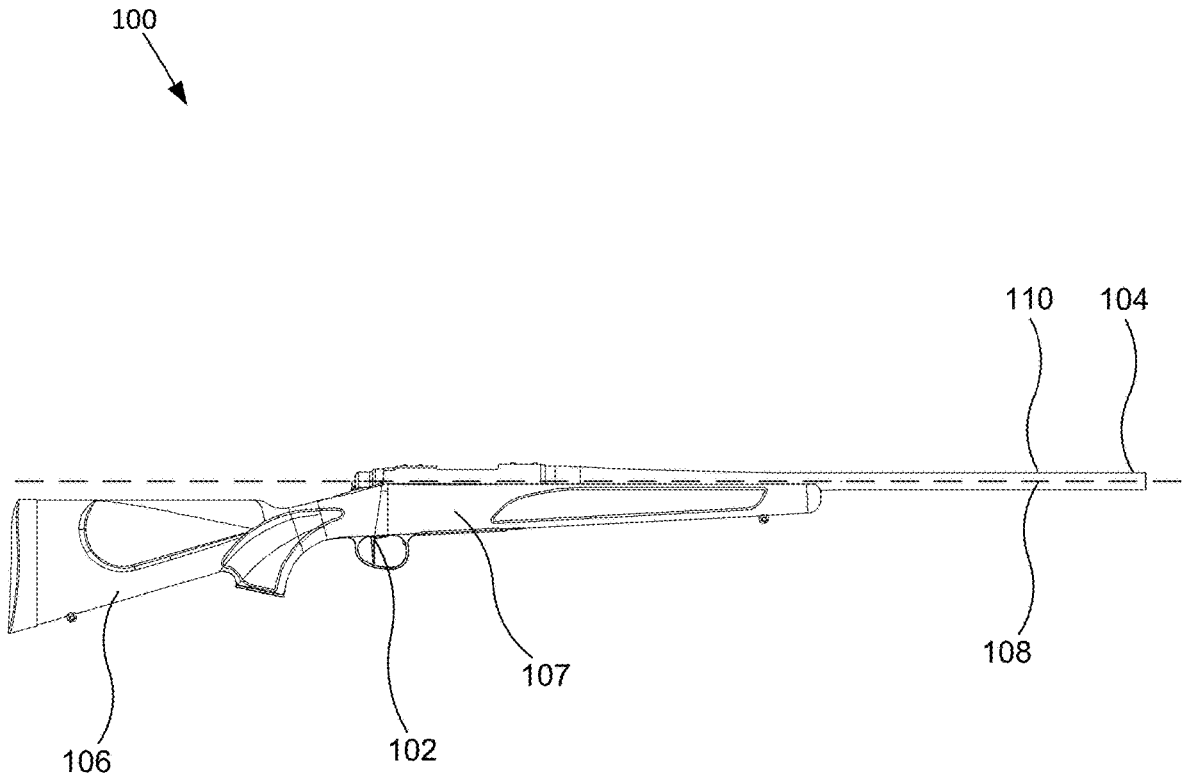
FIG. 1 is a side view diagram illustrating one embodiment of a bolt-action firearm including an improved trigger mechanism in accordance with embodiments of the present disclosure.

FIG. 1 is a side view diagram illustrating one embodiment of a bolt-action firearm 100 including an improved trigger mechanism 102 in accordance with embodiments of the present disclosure. The trigger mechanism, in the depicted embodiments, may be used with the Remington 700 bolt-action rifle, and its variants including the M22, M40, 700P, etc. Additionally, it is contemplated that the components and dimensions of the trigger mechanism 102 may be modified to adapt to use in any bolt-action rifle. As used herein, the terms "forward" and "front" refer to ends of mechanisms that are nearest the muzzle end 104 of the firearm 100. Similarly, "rear," or "rearward," correspond to ends of mechanisms that are furthest from the muzzle end 104 of the firearm (i.e., towards the stock 106).

As will be discussed in greater detail below, the present disclosure N provides a linearly moving trigger slide mounted within a trigger mechanism using compression springs that provide predictability and repeatability of trigger pulls. The trigger slide beneficially moves linearly in relation to a receiver assembly 107 of the firearm 100. In certain examples, the trigger slide moves along an axis that is substantially parallel with a bore axis 108 that is defined by a barrel 110 of the firearm 100.

Figure 2:
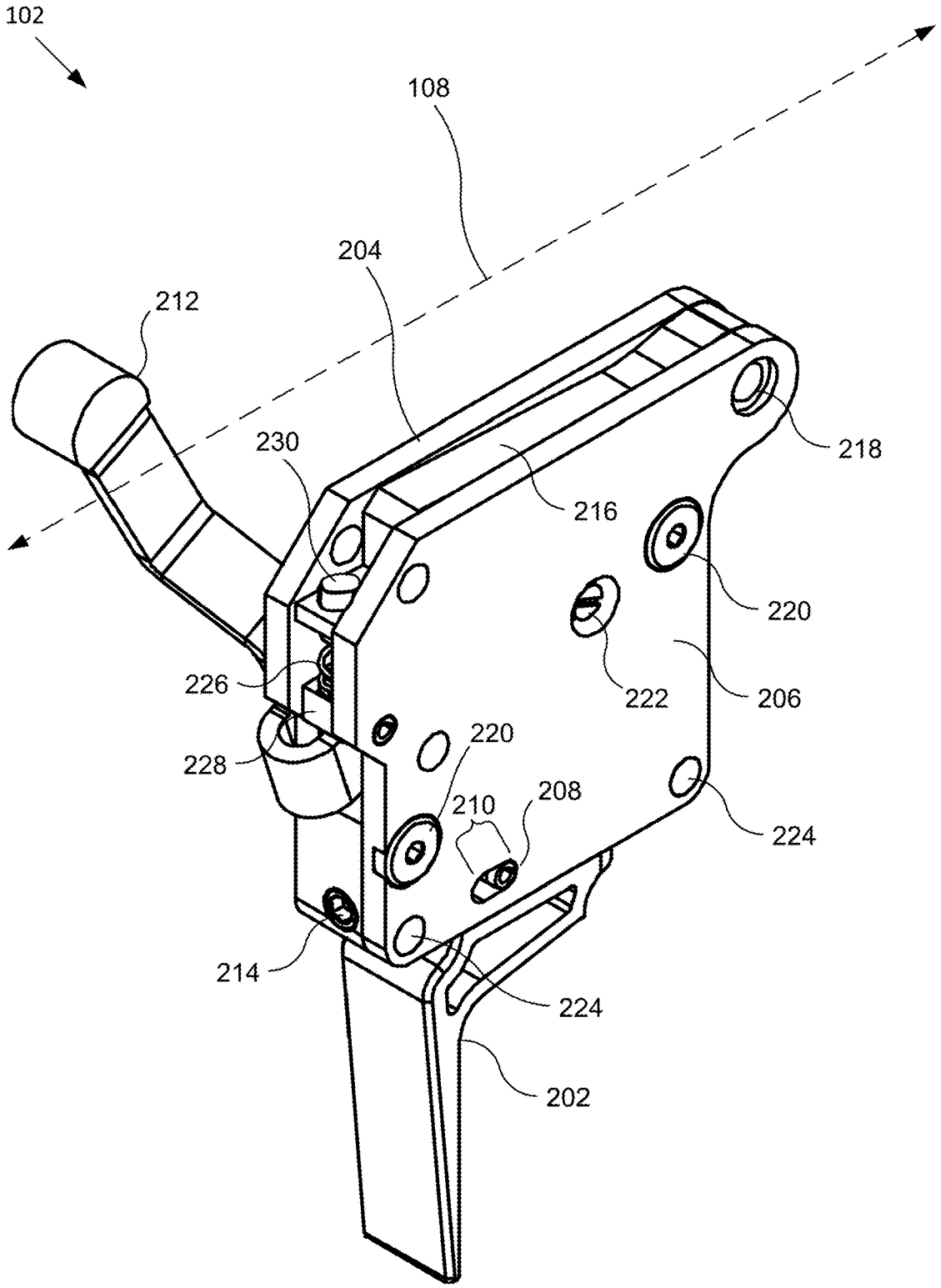
FIG. 2 is a perspective view diagram illustrating one example of a trigger mechanism, in accordance with examples of the subject disclosure.

FIG. 2 is a perspective view diagram illustrating one example of a trigger mechanism 102, in accordance with examples of the subject disclosure. The trigger mechanism 102, in certain examples, includes a trigger 202 that moves linearly with respect to a trigger housing 204 and a side plate 206. The trigger housing 204 and the side plate 206 together maintain the trigger 202, define a pathway for the movement of the trigger 202, and maintain the various components that will be discussed in greater detail below.

The trigger 202, beneficially, moves forward and backward along a linear path that may be parallel to the bore axis 108, as opposed to most triggers that pivot around a pivot point. The benefits of a linearly moving trigger are many, but a primary benefit is that regardless of where a user positions his/her finger on the trigger 202, the amount of force required to pull the trigger 202 (i.e., the "trigger pull") is substantially the same. Conversely, when a user positions his/her finger in different spots on a trigger that pivots, the torque required to pull the trigger depends on how far the finger is from the pivot point of the pivoting trigger. The change in force required between different positions on a pivoting trigger can be up to 2-5 pounds of force.

The trigger 202 moves forward and backward linearly along a path defined by a trigger pathway 208. In certain examples, the trigger pathway 208 is a cutout formed in the trigger housing 204 and a corresponding cutout formed in the side plate 206. The trigger pathway 208 is a linear cutout configured to cause the trigger 202 to follow a linear path when actuated by a user. Although the trigger pathway 208 is depicted as a window or opening in the side plate 206, it is contemplated that other structures, such as a channel formed on interior surfaces, may be utilized.

The trigger pathway 208 operates to define the path and a distance of travel 210 of the trigger 202. In certain examples, the trigger pathway 208 has a distance of travel 210 (i.e., a distance) that is selected to correspond with a desired length of pull of the trigger 202. The length 210 of the trigger pathway 208 may be in a range of between about 0.05 and 0.5 inches. It is contemplated that the length 210 of the trigger pathway 208 may be any suitable length 210, and may be adapted to for a specific firearm. The distance of travel 210, in many instances, is a minimum amount of distance required to actuate the firing pin of the firearm.

In certain examples, the trigger mechanism 102 includes a safety selector 212. The safety selector 212 is configured to move between a first position and a second position. In the first position, the safety selector 212 prevents the trigger mechanism 102 from firing the firearm 100. In the second position, the safety selector 212 allows the trigger mechanism 102 to fire the firearm 100 when the trigger 202 is actuated by a user. In certain examples, the safety selector 212 is coupled to an exterior surface of the trigger mechanism 102, with a portion that wraps into the trigger mechanism to selectively engage a sear, as will be described below in greater detail.

The trigger mechanism 102, in certain examples, includes a trigger tensioning device 214. The trigger tensioning device 214 may include a screw that adjusts the tension of a compression spring (not depicted) that will be described in greater detail below. The trigger tensioning device 214, beneficially, allows the user to modify the trigger pull. An increased tension of the compression spring requires the user to use a greater force to overcome the compression spring and actuate the trigger 202.

In certain examples, the trigger mechanism 102 includes a sear 216 that is disposed between the trigger housing 204 and the side plate 206. The structure of the sear 216 will be discussed below with reference to FIG. 3. The sear 216 is configured to pivot about a bearing 218 or a pin. Features of the sear 216 interact with features of the trigger 202 to translate the linear motion of the trigger 202 into the rotational pivoting movement of the sear 216, as will be discussed in greater detail below.

The trigger mechanism 102, in certain examples, includes various fasteners 220 for coupling the side plate 206 to the trigger housing 204. A ball detent screw 222 is configured to engage openings (see FIG. 3) in the safety selector 212 and maintain the safety selector 212 in either the first position or the second position. Risers 224 formed on the trigger housing 204 are configured to extend through openings of the side plate 206 and position the side plate 206 with respect to the trigger housing 204 during assembly of the trigger mechanism 102.

In certain examples, the trigger mechanism 102 includes a sear return spring 226 that is disposed between an end of the sear 216 and a sear spring base 228. The sear spring base 228 may be integrally formed with either of the trigger housing 204 or the side plate 206. Alternatively, the sear spring base 228 may be independently formed and coupled with the trigger housing 204 and the side plate 206 using a retaining pin or other fastener. In certain examples, the sear return spring 226 is a compression spring that with adjustable tension by way of the sear spring adjustment screw 230. The sear spring adjustment screw 230 is disposed in the end of the sear 216 and is configured to adjust the pre-load of the sear return spring 226. This beneficially allows the user another option to fine tune the trigger pull required to actuate the firearm 100.

Figure 3:
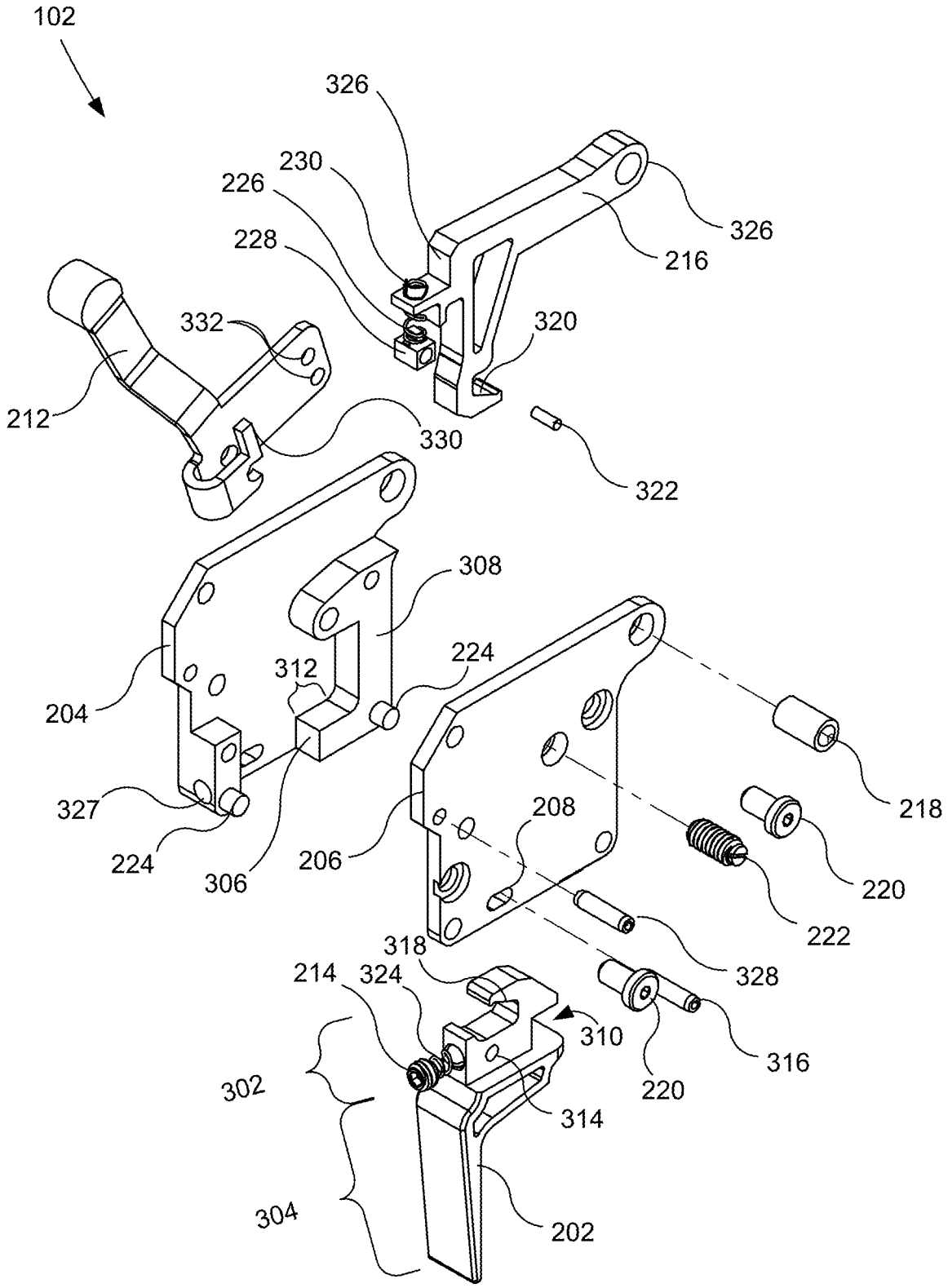
FIG. 3 is an exploded view diagram illustrating one example of the trigger mechanism, in accordance with examples of the subject disclosure.

FIG. 3 is an exploded view diagram illustrating one example of the trigger mechanism 102, in accordance with examples of the subject disclosure. The trigger mechanism 102, as described above with reference to FIG. 2, beneficially provides a trigger 202 that moves linearly, and not rotationally about a pivot point, for a bolt-action firearm. The trigger 202 includes an upper portion 302 and a lower portion 304. The upper portion 302 and the lower portion 304 may be formed as a single unitary unit, or alternatively, formed separately and coupled together by any suitable manner. The upper portion 302 is configured to engage a trigger guide shelf 306.

In certain examples, the trigger guide shelf 306 is formed by a raised portion 308 that extends from the trigger housing 204. The trigger guide shelf 306 is formed with dimensions that correspond with a cutout or pocket 310 in the upper portion 302. The pocket 310 may be formed by features of the upper portion 302 and the lower portion 304. The pocket 310, in certain examples, is configured to slidingly engage with the trigger guide shelf 306. The trigger guide shelf 306, together with the trigger pathway 208, restricts the movement of the trigger 202 with respect to the trigger housing 204. In other words, the trigger guide shelf 306 and the trigger pathway only allow the trigger 202 to move linearly backward and forward with respect to the trigger housing 204, and not rotationally. The trigger guide shelf 306 has a length 312 that is greater than the distance of travel 210 (see FIG. 2) of the trigger pathway 208. This beneficially ensures that as the trigger 202 moves rearward way from the trigger guide shelf 306, the sides of the pocket 310 remain in constant engagement with the trigger guide shelf 306.

The upper portion 302, in certain examples, also includes an opening 314 for receiving a roller pin 316. The roller pin 316 is configured to engage the trigger pathway 208 and move linearly with respect to the trigger housing 204 within the trigger pathway 208. Ends of the trigger pathway 208 define endpoints of travel of the roller pin 316, and correspondingly, endpoints of travel of the trigger 202. In certain examples, the trigger pathway 208 has a length or distance of travel (see FIG. 2) that is selected to minimize the distance of travel of the trigger 202 required to fire the firearm 100. In other words, the length of the trigger pathway 208 is as short as possible while still allowing the sear 216 to actuate the firing pin of the firearm 100. However, it is contemplated that the distance may be greater based on user preference.

Figure 4:
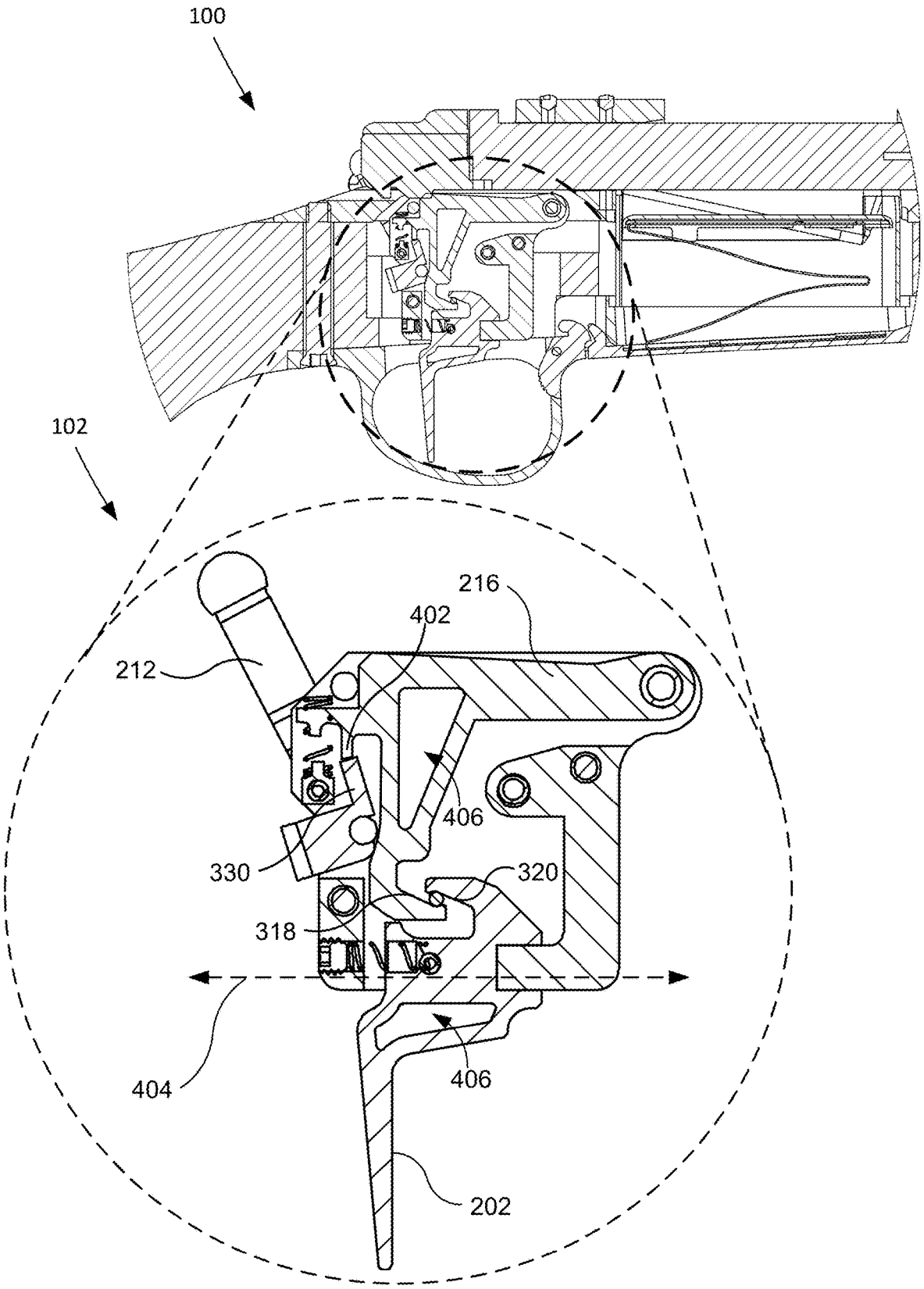
FIG. 4 is a cross-sectional view diagram of a firearm, in accordance with examples of the subject disclosure.

As will be discussed in greater detail below, with reference to FIG. 4, the upper portion 302 includes an angled engagement surface 318 that corresponds with an angled engagement surface 320 of the sear 216. A roller pin 322 is captured by and disposed between the angled engagement surface 318 and the angled engagement surface 320. Lips or ridges formed at the ends of the angled engagement surfaces are configured to retain the roller pin. The term "angled" refers to a planar surface that is not parallel with the bore axis 108 (see FIG. 1). Stated differently, the angled engagement surfaces 318, 320 are oriented at an angle with respect to the bore axis 108 when viewed in a side cross-sectional view as depicted in FIG. 4. Also depicted, with respect to the upper portion 302 of the trigger 202, is a trigger compression spring 324 that is configured to return the trigger 202 to a first or default position that is at the forward end of the trigger pathway 208. As described above, the tensioning screw 214 adjusts the preload of the compression spring 324. Opening 327 receives the tensioning screw 214.

In certain examples, the sear 216 is configured with a pivot point 326 disposed adjacent a first end while the angled engagement surface 320 is disposed adjacent a second end of the sear 216. The sear 216, in certain examples, is a member having arms that extend away from a firing pin engagement surface 326 in substantially orthogonal directions with respect to one another. In other words, the sear 216 may be formed having a generally L-shaped cross-sectional profile. However, any suitable cross-sectional profile may be utilized. The sear 216, as described above with reference to FIG. 2, includes a sear return spring 226 disposed between the sear 216 and the sear spring base 228. A positioning pin 328 secures the position of the sear spring base 228 with respect to the trigger housing 204.

The safety selector 212 is configured to pivot, with respect to the trigger housing 204, between a first position and a second position. In the first position, the safety selector 212 prevents the trigger mechanism 102 from firing the firearm 100 by preventing the sear 216 from moving. A sear engagement tab 330, when the safety selector 212 is in the first position, prevents the sear 216 from pivoting downward and releasing the firing pin. In the second position, the safety selector 212 allows the trigger mechanism 102 to fire the firearm 100 when the trigger 202 is actuated by a user because the sear engagement tab 330 moves into a pocket of the sear 216, as will be discussed in greater detail below with reference to FIGS. 4-5C.

In certain examples, the safety selector 212 also includes positioning openings 332 that are configured to engage the ball detent screw 222. The positioning openings 332 define the first position and the second position of the safety selector 212. In other words, the positioning openings 332 correctly position the safety selector 212 so that the sear engagement tab 330 is either in position to prevent movement of the sear 216 or in position to allow movement of the sear 216.

FIG. 4 is a cross-sectional view diagram of a firearm 100, in accordance with examples of the subject disclosure. In particular, FIG. 4 depicts the trigger mechanism 102 within the firearm 100, and an expanded cross-sectional view of the trigger mechanism 102. In the depicted embodiment, the safety selector 212 is in the first position that prevents movement of the sear 216. In this position, the sear engagement tab 330 of the safety selector 212 is aligned with and in engagement with a tab 402 of the sear 216. The contact between the sear engagement tab 330 and the tab 402 prevents any rotational movement of the sear 216 about its pivot point (see 218 of FIG. 2). When the safety selector 212 is in the second position, the sear engagement tab 330 moves into a pocket formed by the tab 402 and the main body of the sear 216. The pocket allows for the sear 216 to pivot downward without being impeded by the sear engagement tab 330. The pocket will be described in greater detail below with reference to FIGS. 5A-5C.

The linear movement of the trigger 202, when the safety selector 212 is in the second position (see FIG. 5A), defines an axis 404 of movement of the trigger 202. In certain examples, the axis 404 is parallel with the bore axis 108 (see FIG. 1). There are many benefits to a linear pull trigger 202, as described above. The angled engagement surfaces 318, 320 form an angle with respect to the axis 404. In some examples, the angle is in the range of between about 1 degree and 45 degrees. With the safety selector 212 in the second position, as the trigger 202 moves rearward, the angled engagement surface 318 of the upper portion causes the roller pin to move rearward. Because the trigger 202 is bound vertically with respect to the trigger housing 204 (see FIG. 2), the ramp of the angled engagement surface 318 creates a downward force on the sear 216 as it moves. This downward force pivots the sear 216 in a counter clockwise direction, in this depiction, which causes the sear 216 to release the firing pin of the firearm 100.

In certain examples, the trigger 202 and the sear 216 are formed with cutouts 406. The cutouts 406 function to reduce the mass of the trigger 202 and the sear 216. Reduced mass is beneficial in at least two aspects: first, the weight of the trigger mechanism 102 is reduced which helps to lighten the weight of the firearm 100; and second, if dropped while the safety selector is in the second position, a reduced mass trigger 202 is unlikely to have the momentum needed to accidentally fire the firearm 100.

Figure 5A:
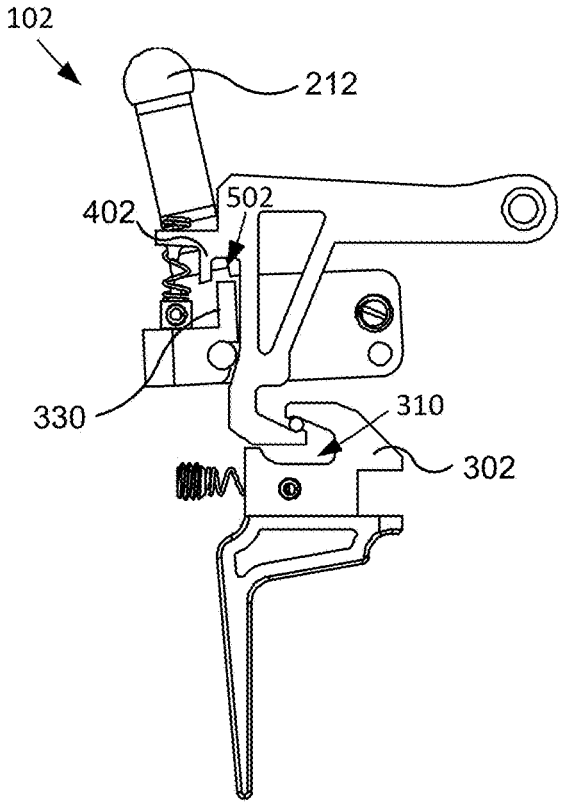
FIG. 5A is partial side view diagram of the trigger mechanism, in accordance with examples of the subject disclosure.
Figure 5B:
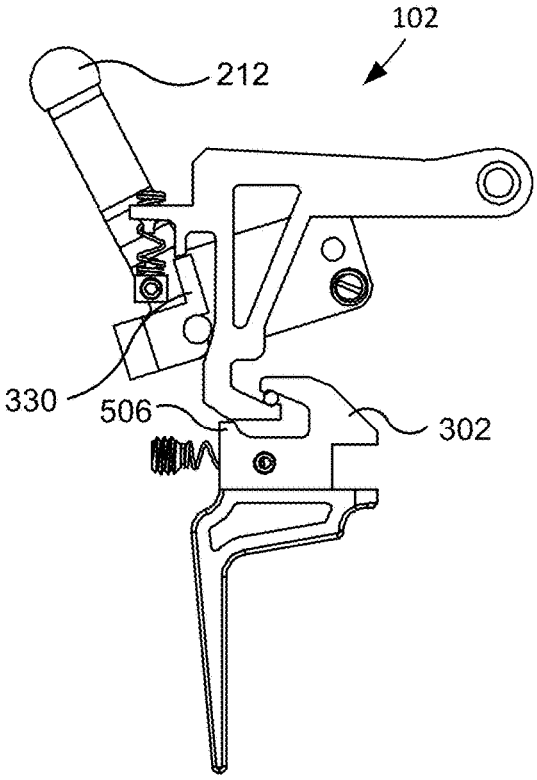
FIG. 5B is another partial side view diagram of the trigger mechanism, in accordance with examples of the subject disclosure.
Figure 5C:
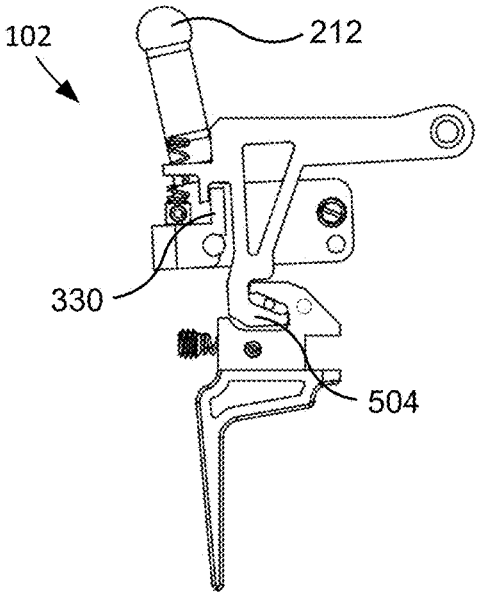
FIG. 5C is another partial side view diagram of the trigger mechanism, in accordance with examples of the subject disclosure.

FIGS. 5A-5C are partial side view diagrams of the trigger mechanism 102, in accordance with examples of the subject disclosure. In particular, these figures depict the different positions of the safety selector 212 with respect to the trigger housing 204. FIGS. 5A and 5C depicts the safety selector 212 in the second position, or the position where the safety selector 212 allows the sear 216 (see FIG. 2) to actuate the firing pin. In the second position, the sear engagement tab 330 is received into a pocket 502 that is formed by the tab 402 that extends from the sear 216 and the main portion of the sear 216. When the safety selector 212 is in this position, an end 504 of the sear 216 is receivable into the pocket 310 formed by the upper portion 302 of the trigger 202. FIG. 5C depicts an actuated trigger 202, where the sear engagement tab 330 and the end 504 are fully received into their respective pockets 502, 310.

FIG. 5B illustrates the safety selector 212 in the first position, or the position that prevents rotational movement of the sear 216. When in the first position, the sear engagement tab 330 is aligned with the tab 402 of the sear 216, this contact prevents movement of the sear 216. Further, a raised portion 506 of the upper portion 302 engages the end 504 of the sear 216 to assist in preventing movement of the sear 216.

Figure 6:
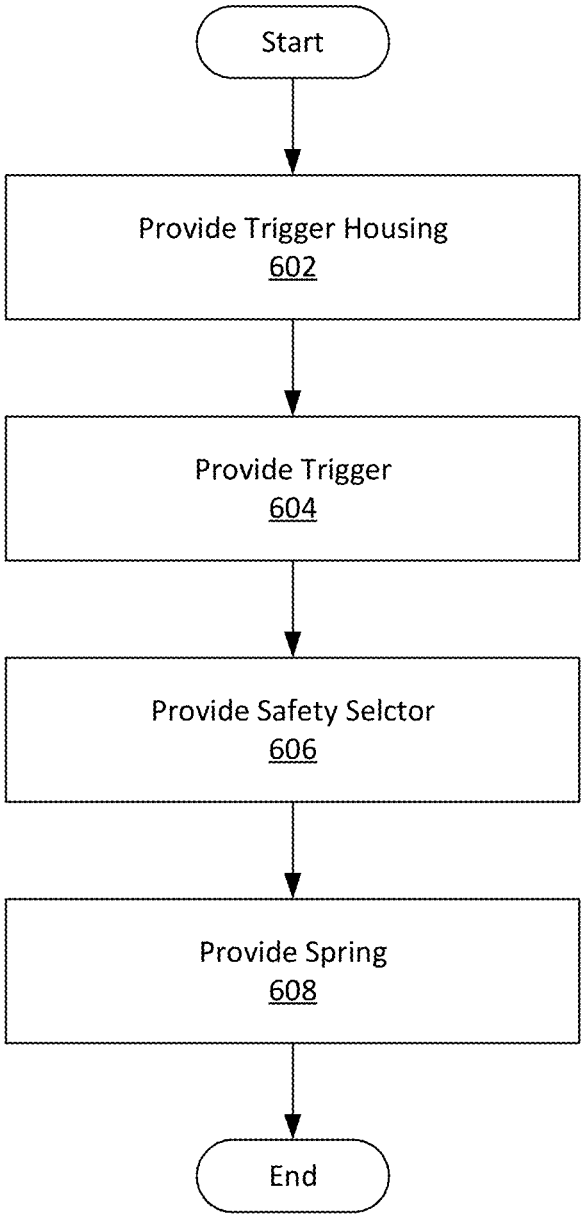
FIG. 6 is a schematic flowchart diagram illustrating an example of providing an improved trigger mechanism, according to examples of the subject disclosure.

FIG. 6 is a schematic flowchart diagram illustrating an example of providing an improved trigger mechanism, according to examples of the subject disclosure. The method, in certain examples, includes providing a trigger housing 602. In certain examples, the trigger housing provides a linear pathway through which a trigger moves from a first position to a second position. The trigger housing also provides various openings and cutouts for mounting a sear and a safety selector. The method also includes providing a trigger 604 with an angled sear engagement surface. In certain examples, the method also includes providing 606 a safety selector that is moveable between a first position and second position. In certain examples, the safety selector has a sear engagement tab that selectively engages the sear to prevent the sear from moving with respect to the trigger housing. The method also includes providing 608 compression springs for returning the trigger and the sear to their default or first positions, respectively. In other examples, the method includes providing other necessary and optional components to improve the functionality of the trigger mechanism.

Figure 7:
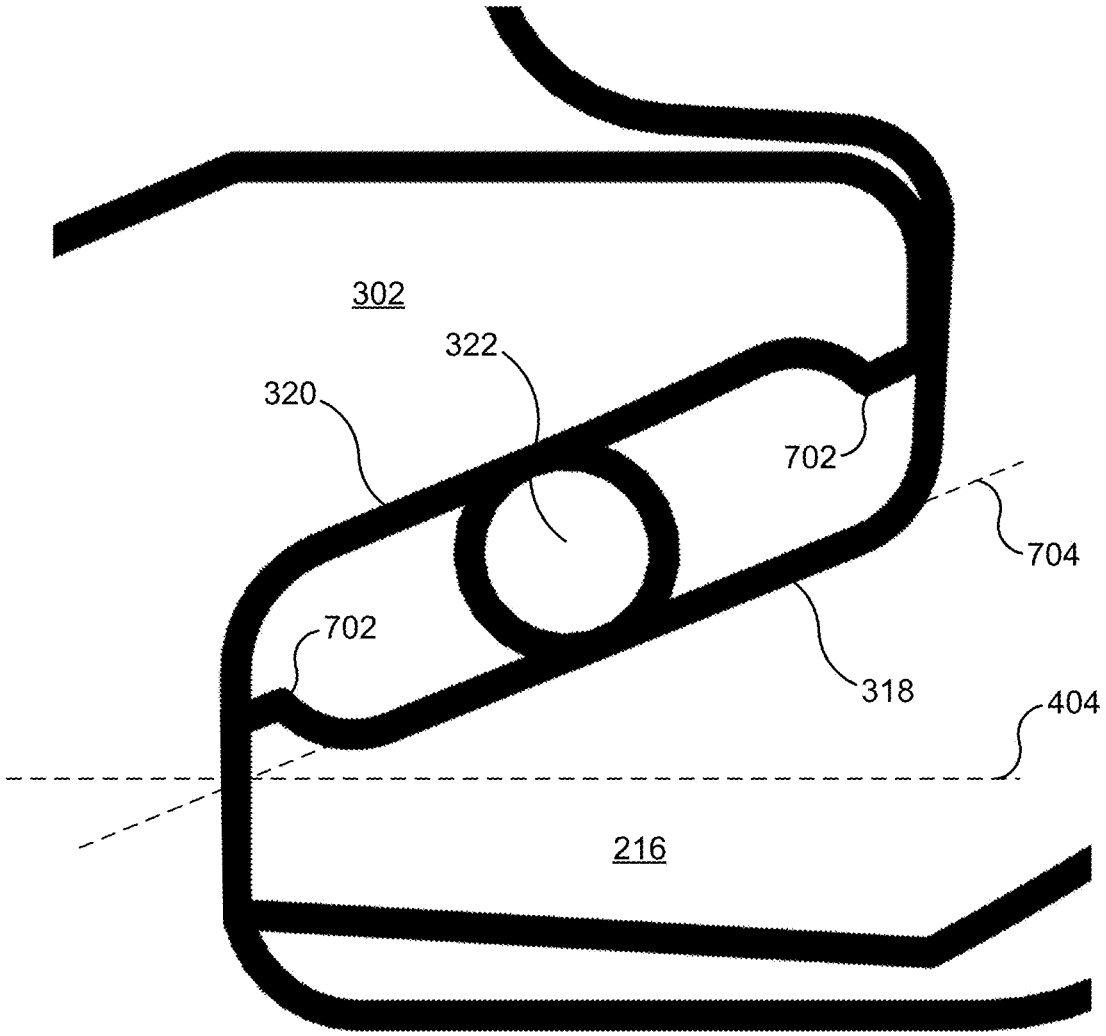
FIG. 7 is a schematic flowchart diagram illustrating an example of the angled engagement surfaces, in accordance with examples of the subject disclosure.

FIG. 7 is a schematic block diagram illustrating one example of angled engagement surface 318, 320, in accordance with examples of the subject disclosure. As described previously, The upper portion 302 and the seer 216 capture the roller pin 322. Lips 702 formed at ends of the angled engagement surfaces 318, 320 prevent the roller pin 322 from escaping the angled engagement surfaces 318, 320. Although a single roller pin 322 is depicted, it is contemplated that any useful number of rolling pins 702 may be used.

The angled engagement surfaces 318, 320 are disposed at an angle 704 with respect to the axis 404, or the bore axis. In certain examples, the angle 704 is in the range of between about 1 and 60 degrees. In other examples, the angle 704 (depicted by the dotted line) is in the range of between about 5 and 45 degrees. In yet other examples, the angle 704 is in the range of between about 15 and 35 degrees. Beneficially, selecting a specific angle allows a user to fine tune the force required to pull the trigger 202. This allows a user to adjust trigger pull for his or her specific firearm.

In certain examples, planes formed by the angled engagement surfaces 318, 320 are parallel, and have substantially the same angle 704 with respect to the axis 404. As used herein, when referring to a numerical value, the term "substantially" refers to any value that is within ±10% of the stated value.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A trigger mechanism for a firearm, comprising:

a trigger housing having a linear trigger pathway;

a removeable side plate;

a trigger that is at least partially disposed between the trigger housing and the removeable side plate, where the trigger is configured to move between a first position and a second position to actuate a firing pin along a path that is defined by the trigger pathway, and where the trigger includes an angled sear engagement surface with respect to the linear trigger pathway;

a sear that is at least partially disposed between the trigger housing and the removeable side plate and is configured to pivot with respect to the trigger housing, where the sear includes an angled trigger engagement surface that corresponds with the angled sear engagement surface;

a roller pin captured between the angled sear engagement surface and the angled trigger engagement surface, where the roller pin is configured to transfer a force applied to the trigger to the sear.

2. The trigger mechanism of claim 1, where the linear trigger pathway has a length in a range of between about 0.05 and 0.5 inches.

3. The trigger mechanism of claim 2, where the trigger housing includes a trigger guide shelf configured to engage a pocket formed in an upper portion of the trigger, where the trigger guide shelf prevents rotational movement of the trigger with respect to the trigger housing.

4. The trigger mechanism of claim 3, where the trigger guide shelf has a length that is greater than a length of the linear trigger pathway.

5. The trigger mechanism of claim 1, further comprising a safety selector configured to move between a first position that prevents movement of the sear with respect to the trigger housing and a second position that allows movement of the sear with respect to the trigger housing.

6. The trigger mechanism of claim 5, where the safety selector further comprises a sear engagement tab that is moveable into and out of engagement with a tab of the sear.

7. The trigger mechanism of claim 6, where the tab of the sear forms a pocket with a body portion of the sear, and where the pocket is configured to receive the sear engagement tab when the safety selector is in the second position.

8. The trigger mechanism of claim 6, where the sear engagement tab of the safety selector aligns with and contacts the tab of the sear when the safety selector is in the first position to prevent the sear from moving with respect to the trigger housing.

9. The trigger mechanism of claim 1, further comprising a compression spring disposed between the trigger and the trigger housing configured to return the trigger to a first position.

10. A firearm having a linearly moveable trigger with respect to the firearm, the firearm comprising:

a trigger housing having a linear trigger pathway;

a removeable side plate;

a trigger that is at least partially disposed between the trigger housing and the removeable side plate, where the trigger is configured to move between a first position and a second position to actuate a firing pin along a path that is defined by the trigger pathway, and where the trigger includes an angled sear engagement surface with respect to the linear trigger;

a sear that is at least partially disposed between the trigger housing and the removeable side plate and is configured to pivot with respect to the trigger housing, where the sear includes an angled trigger engagement surface that corresponds with the angled sear engagement surface;

a roller pin captured between the angled sear engagement surface and the angled trigger engagement surface, where the roller pin is configured to transfer a force applied to the trigger to the sear.

11. The firearm of claim 10, where the linear trigger pathway has a length in the range of between about 0.05 and 0.5 inches.

12. The firearm of claim 11, where the trigger housing includes a trigger guide shelf configured to engage a pocket formed in an upper portion of the trigger, where the trigger guide shelf prevents rotational movement of the trigger with respect to the trigger housing.

13. The firearm of claim 12, where the trigger guide shelf has a length that is greater than a length of the linear trigger pathway.

14. The firearm of claim 10, further comprising a safety selector configured to move between a first position that prevents movement of the sear with respect to the trigger housing and a second position that allows movement of the sear with respect to the trigger housing.

15. The firearm of claim 14, where the safety selector further comprises a sear engagement tab that is moveable into and out of engagement with a tab of the sear.

16. The firearm of claim 15, where the tab of the sear forms a pocket with a body portion of the sear, and where the pocket is configured to receive the sear engagement tab when the safety selector is in the second position.

17. The firearm of claim 15, where the sear engagement tab of the safety selector aligns with and contacts the tab of the sear when the safety selector is in the first position to prevent the sear from moving with respect to the trigger housing.

18. The firearm of claim 10, further comprising a compression spring disposed between the trigger and the trigger housing configured to return the trigger to a first position.

* * * * *